US007347152B1

(12) United States Patent
Wu et al.

(10) Patent No.: US 7,347,152 B1
(45) Date of Patent: Mar. 25, 2008

(54) ADJUSTABLE POSITIONING DEVICE FOR HEAD OF SEWING MACHINE

(75) Inventors: Jui-Yi Wu, Pa Deh (TW); Hsien-Chin Chang, Sanchong (TW)

(73) Assignee: Sewtech Corporation, Taoyuan County (TW)

( * ) Notice: Subject to any disclaimer, the term of this patent is extended or adjusted under 35 U.S.C. 154(b) by 0 days.

(21) Appl. No.: 11/707,782

(22) Filed: Feb. 16, 2007

(51) Int. Cl.
*D05B 73/02* (2006.01)
*D05B 69/30* (2006.01)

(52) U.S. Cl. ..... 112/259

(58) Field of Classification Search ..... 112/2, 112/259, 258, 221, 162, 470.18, 470.13
See application file for complete search history.

(56) References Cited

U.S. PATENT DOCUMENTS 290,162 A * 12/1883 Winchell ..... 112/259
349,438 A * 9/1886 Looker ..... 112/259
361,426 A * 4/1887 Looker ..... 112/258
364,769 A * 6/1887 Palmer, Jr. ..... 112/259
418,890 A * 1/1890 Dimond et al. ..... 112/220
2,709,978 A * 6/1955 Adler ..... 112/258
4,333,410 A * 6/1982 Taketomi ..... 112/162
4,787,324 A * 11/1988 Fischer et al. ..... 112/470.18

* cited by examiner

*Primary Examiner*—Ismael Izaguirre
(74) *Attorney, Agent, or Firm*—Alan Kamrath; Kamrath & Associates PA

(57) ABSTRACT

A sewing machine includes a main frame including a needle seat, a beam, and a head supported by the beam. The head includes elements for sewing operation in association with the needle seat. A fixed seat is fixed to the beam and a rotational seat is fixed to the head to turn therewith. The rotational seat and the fixed seats include aligned axial holes. A shaft sleeve extends from the rotational seat and rotatably extends through the axial hole of the fixed seat. The head and the rotational seat are movable relative to the fixed seat between an operative position allowing sewing operation and an inoperative position angularly spaced from the operative position. A distance between the head and the needle seat is increased when the head is moved from the operative position to the inoperative position, allowing easy insertion and removal of thick materials during a sewing operation.

10 Claims, 12 Drawing Sheets

ADJUSTABLE POSITIONING DEVICE FOR HEAD OF SEWING MACHINE

BACKGROUND OF THE INVENTION

1. Field of the Invention

The present invention relates to an adjustable positioning device for a head of a sewing machine, allowing easy insertion and removal of thick materials during a sewing operation.

2. Description of the Related Art

A typical sewing machine includes a needle, a presser foot fixed below the needle, and a needle seat below the presser foot. A material to be sewed is inserted into a space between the presser foot and the needle seat and removed after sewing. In a case of a sewing operation of multiple layers of cloth or leather or of a thick material having a total thickness greater than the space between the presser foot and the needle seat, the needle and the presser foot are detached before insertion of the material and then reassembled for sewing operation, and the same detaching and reassembling procedures are required for removal of the thick material, resulting in troublesome operation. Furthermore, in another case that the material has to be rolled in the space, the rolled and sewed material can only be removed in a forward/backward direction, not allowing removal in a lateral direction, leading to inconvenience and difficulties to operation.

SUMMARY OF THE INVENTION

An objective of the present invention is to provide an adjustable positioning device for a head of a sewing machine, allowing easy insertion and removal of thick materials during a sewing operation, allowing easy sewing operation, saving labor and time, and enhancing efficiency.

A sewing machine in accordance with the teachings of the present invention includes a main frame including a needle seat, a beam, and a head supported by the beam. The head and the needle seat have a spacing therebetween. The head includes elements for sewing operation in association with the needle seat. A fixed seat is fixed to the beam and includes a first axial hole. A rotational seat is fixed to the head to turn therewith. The rotational seat includes a second axial hole aligned with the first axial hole of the fixed seat. The rotational seat includes a shaft sleeve rotatably extending through the first axial hole of the fixed seat. The second axial hole and the shaft sleeve of the rotational seat are adapted to be extended through by a rotational shaft coupled to the head for the sewing operation. The head and the rotational seat are movable relative to the fixed seat between an operative position allowing sewing operation and an inoperative position angularly spaced from the operative position. The head and the needle seat are spaced by the spacing when the head is in the operative position. A distance between the head and the needle seat is greater than the spacing when the head is in the inoperative position to allow easy insertion and removal of thick materials during a sewing operation.

In a preferred form, the beam includes a front beam and a rear beam between which the fixed seat and the rotational seat are mounted. More specifically, the fixed seat is fixed to the rear beam, the rotational seat is mounted to an end of the front beam, and the head being mounted to the other end of the front beam. In another preferred form, the fixed seat and the rotational seat are mounted between the beam and the head.

In the preferred form, the fixed seat further includes a radial screw hole in communication with the first axial hole.

The rotational seat includes a recess in an outer periphery thereof. A ball is mounted in the radial screw hole of the fixed seat and releasably engageable with the recess of the rotational seat. A retaining member is threadedly engaged with the radial screw hole and threadedly movable between a first position pressing the ball to be securely engaged with the recess of the rotational seat and a second position disengaged from the ball and allowing the ball to be disengaged from the recess of the rotational seat when the rotational seat is turned relative to the fixed seat.

In the preferred form, the beam includes a groove, and the rotational seat includes a through-hole aligned with the groove. Furthermore, the fixed seat includes a first positioning hole aligned with the through-hole of the rotational seat. A positioning rod is received in the groove, and a clutch pin is attached to an end of the positioning rod and extended through the through-hole of the rotational seat into the first positional hole of the fixed seat, thereby maintaining the head in the operative position. The positioning rod is movable to disengage the clutch pin from the first positioning hole of the fixed seat to allow rotational movement of the rotational seat relative to the fixed seat.

In the preferred form, a fixed member is fixed in the groove and has a hole for slideable receipt of another end of the positioning rod. A guide seat is mounted in the groove and extended through by the positioning rod. A spring is mounted between the guide seat and the fixed member for biasing the clutch pin to engage with the first positioning hole of the fixed seat.

In the preferred form, the fixed seat further including a plurality of second positioning holes angularly spaced from the first positioning hole, and the clutch pin is selectively engaged with one of the second positioning holes when the head is in the inoperative position.

In the preferred form, the positioning rod includes a bearing extending out of the groove. A bolt extends through the bearing and is fixed to the positioning rod. A rocker arm includes a pivot pin pivotally connected to the beam, a first arm for manual operation, and a second arm abutting against the bearing. The first arm is pressable to move the clutch pin to disengage from one of the first and second positioning holes of the fixed seat.

In the preferred form, a sleeve extends from a face of the fixed seat in the longitudinal direction of the rotational shaft, and the shaft sleeve of the rotational shaft extends through the sleeve of the fixed seat.

In the preferred form, a stop ring is fixed to an end face of the shaft sleeve of the rotational sleeve and has a peripheral edge abutting against an end face of the sleeve of the fixed seat to prevent the rotational seat from disengaging from the fixed seat while allowing rotational movement of the rotational seat relative to the fixed seat.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
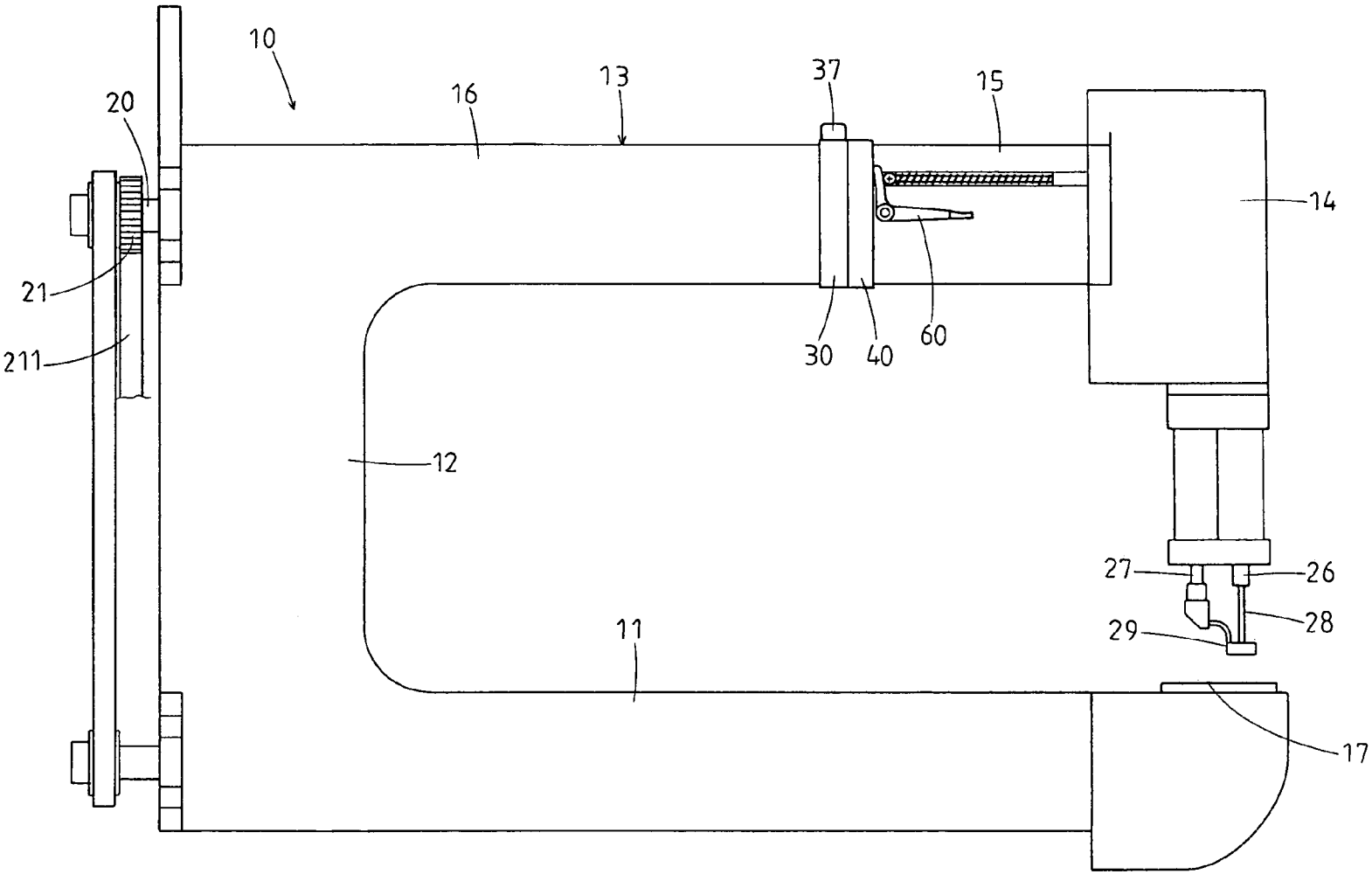
FIG. 1 is a side view of a sewing machine with an adjustable positioning device for a head in accordance with the present invention.

FIGS. 1 to 12 illustrate a preferred embodiment of a sewing machine in accordance with the present invention. The sewing machine includes a main frame 10 having a stand 11. A needle seat 17 is provided on an end of the stand 11, and a vertical post 12 extends upright from the other end of the stand 11. A beam 13 extends from an upper end of the vertical post 12 and parallel to the stand 11. A head 14 is coupled to a distal end of the beam 13. Elements in association with sewing operations such as a needle bar 26, a needle 28, a presser bar 27, and a presser foot 28 are mounted to the head 14 and face the needle seat 17. A rotational shaft 20 has an end coupled to the head 14 and can be driven by a pulley 21 and a belt 211.

An adjustable positioning device is mounted to the beam 13 and includes a fixed seat 30 and a rotational seat 40. In the preferred form, the beam 13 includes a front beam 15 and a rear beam 16, and the fixed seat 30 and the rotational seat 40 are mounted between the front beam 15 and the rear beam 16.

Figure 14:
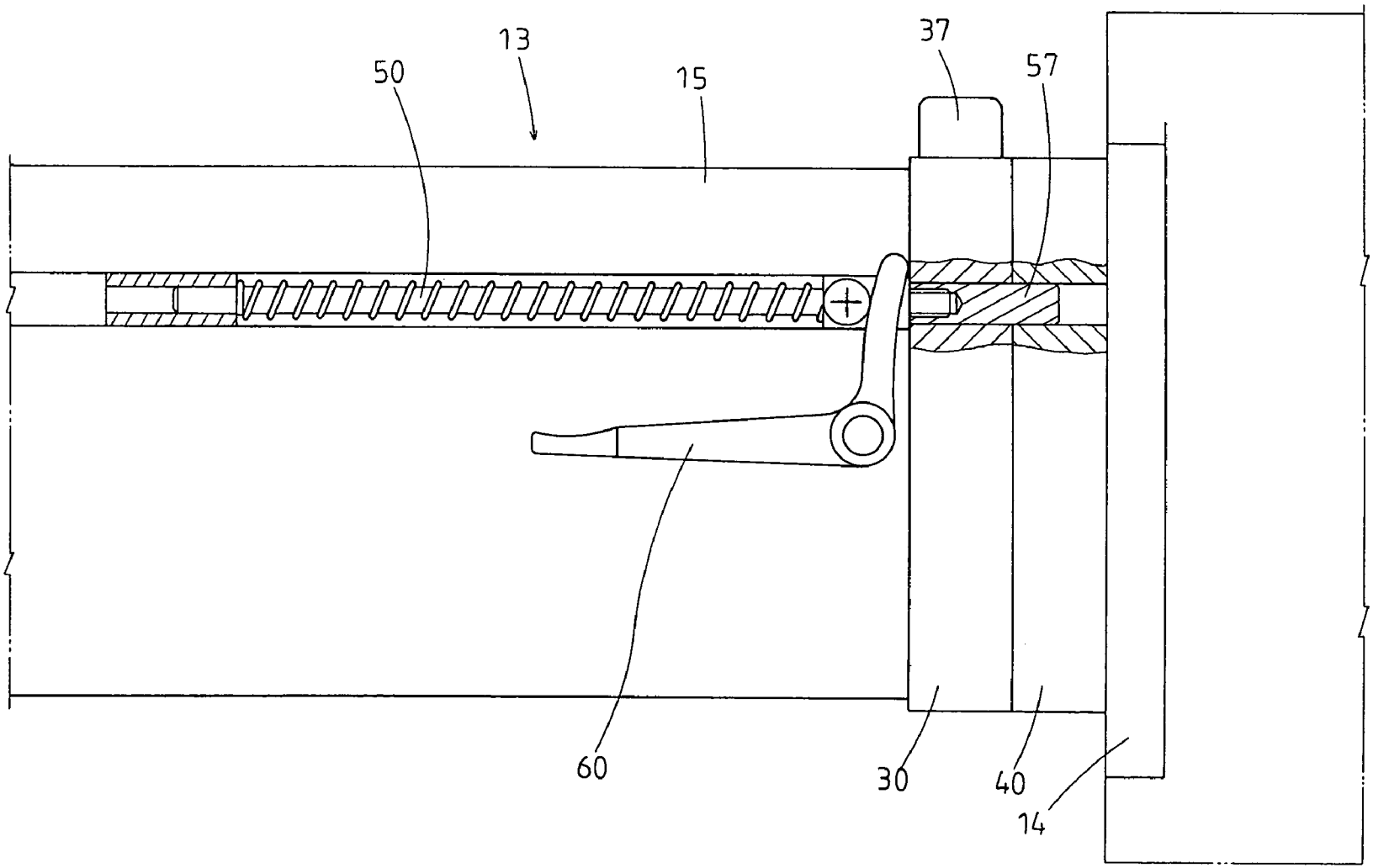
FIG. 14 is a partially sectioned side view illustrating another arrangement of the adjustable positioning device in accordance with the present invention.

In another preferred embodiment shown in FIG. 14, the beam 13 is a single member, and the fixed seat 30 and the rotational seat 40 are mounted between the beam 13 and the head 14.

Figure 2:
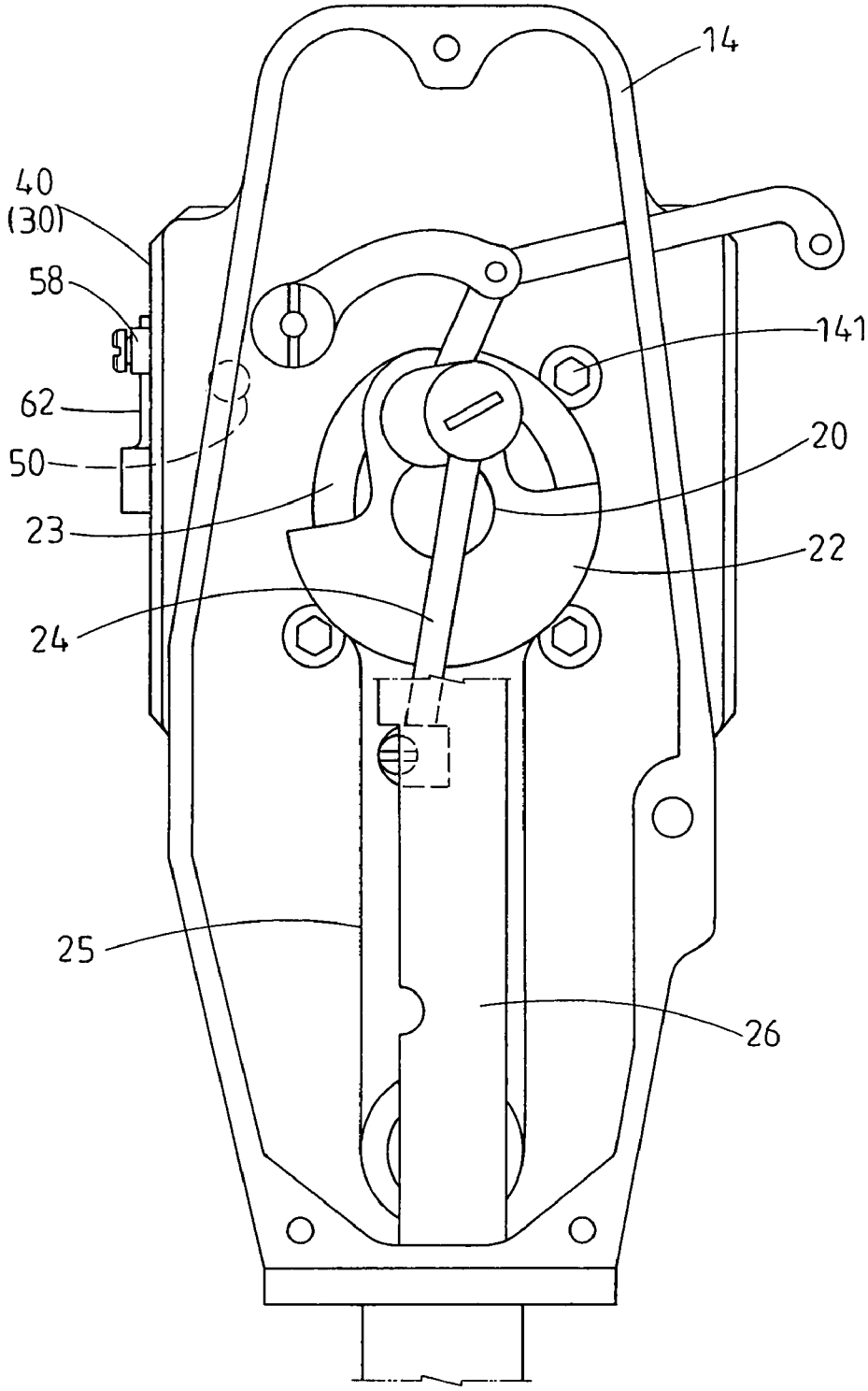
FIG. 2 is a side view illustrating the head of the sewing machine in accordance with the present invention.

With reference to FIGS. 1 and 2, the rotational shaft 20 extends in the head 14 is coupled to and drives a needle bar eccentric wheel 22 and a needle bar connecting rod 24 for driving the needle 26 and the needle 28. The rotational shaft 20 is also coupled to and drives a presser bar eccentric wheel 23 and a presser bar connecting rod 25 for driving the presser bar 27 and the presser foot 29. A plurality of bolts 141 are extended through holes (not shown) in the head 14 into screw holes 18 (FIG. 3) in the front beam 13.

Figure 3:
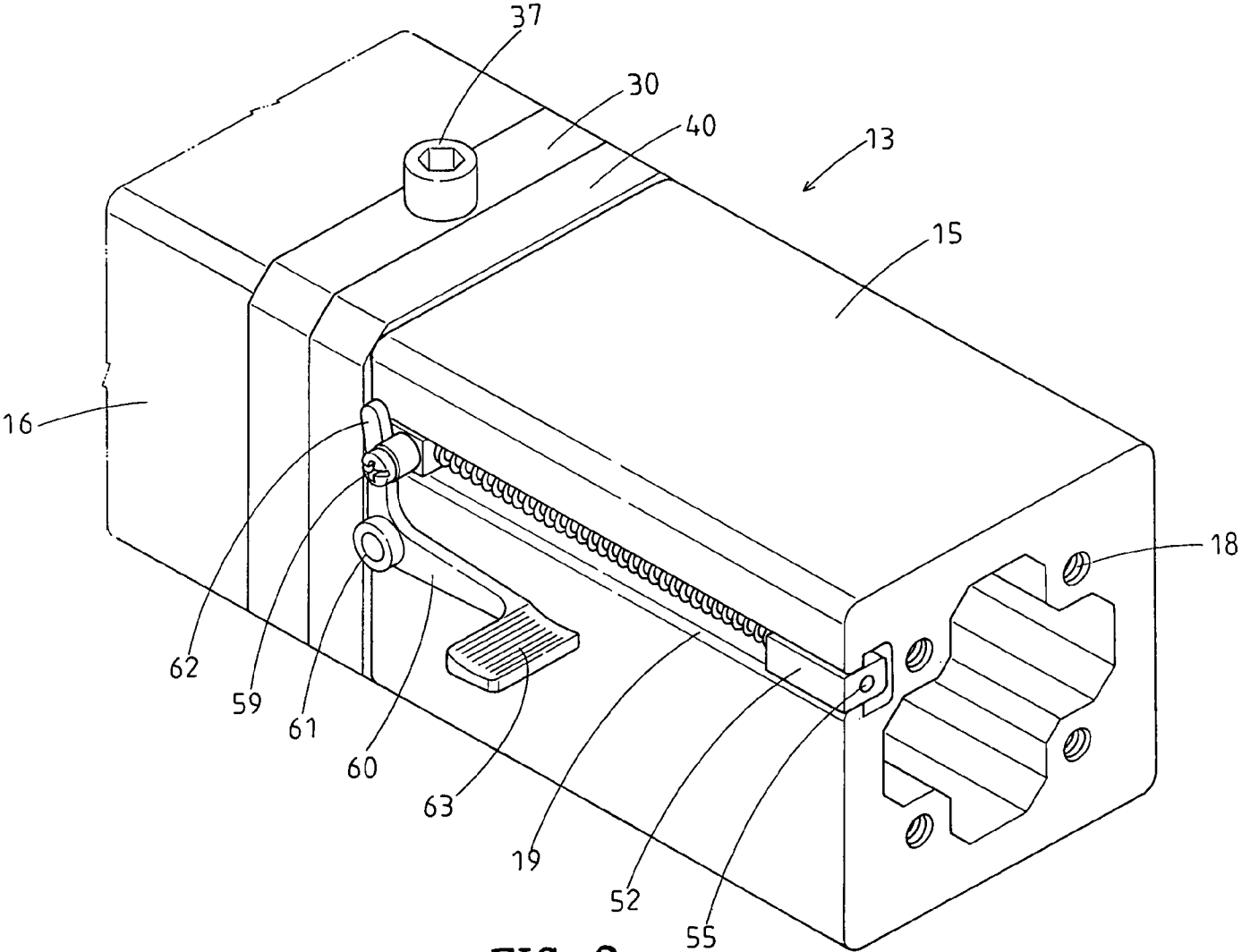
FIG. 3 is a perspective view illustrating a portion of a beam of the sewing machine in accordance with the present invention.
Figure 4:
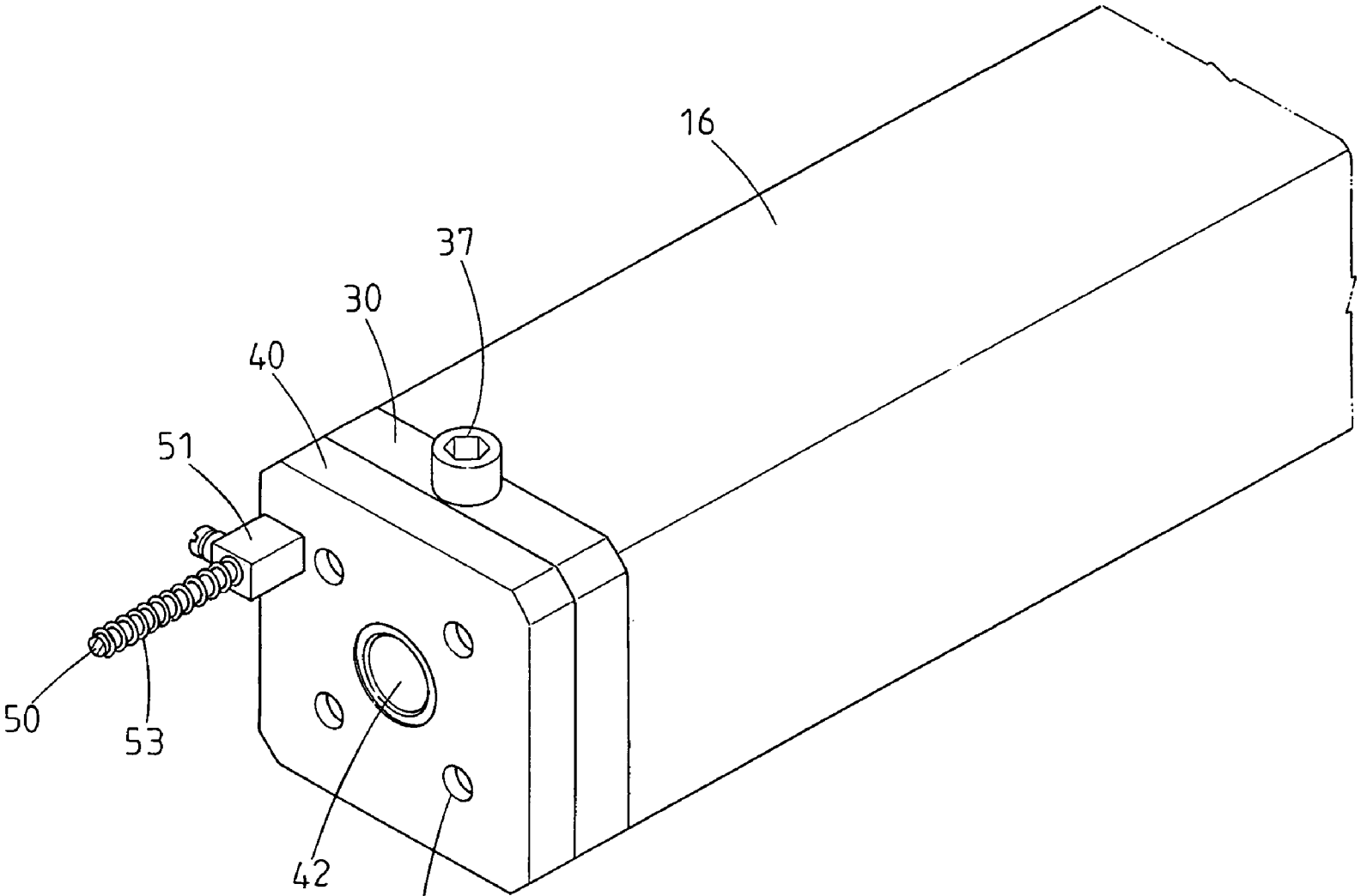
FIG. 4 is a perspective view illustrating the adjustable positioning device in accordance with the present invention.
Figure 5:
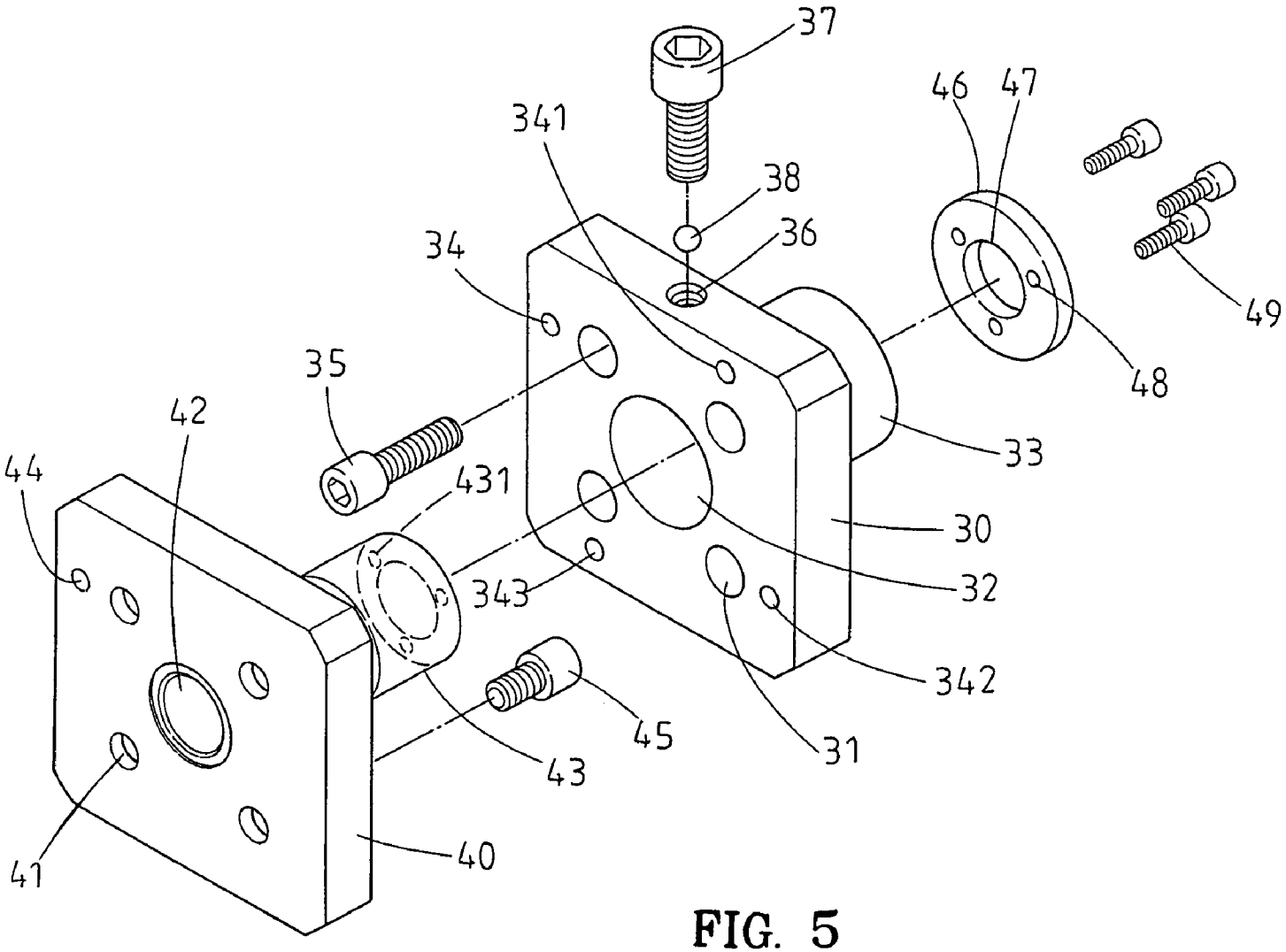
FIG. 5 is an exploded perspective view of the adjustable positioning device.
Figure 9:
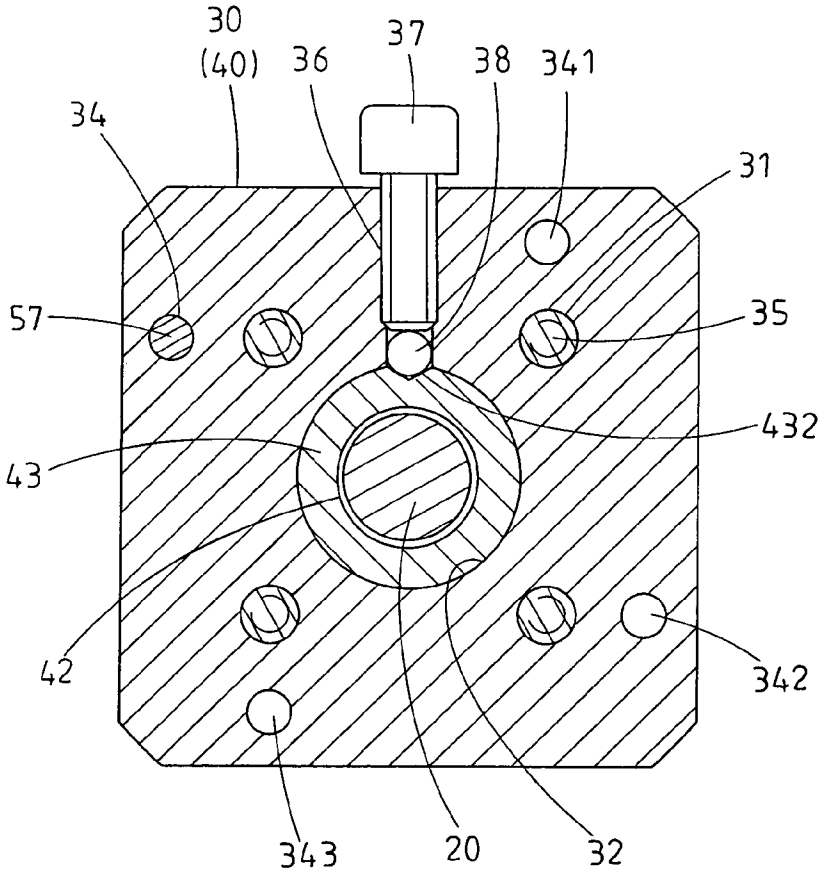
FIG. 9 is a sectional view of the adjustable positioning device in an operative position for sewing operation.
Figure 12:
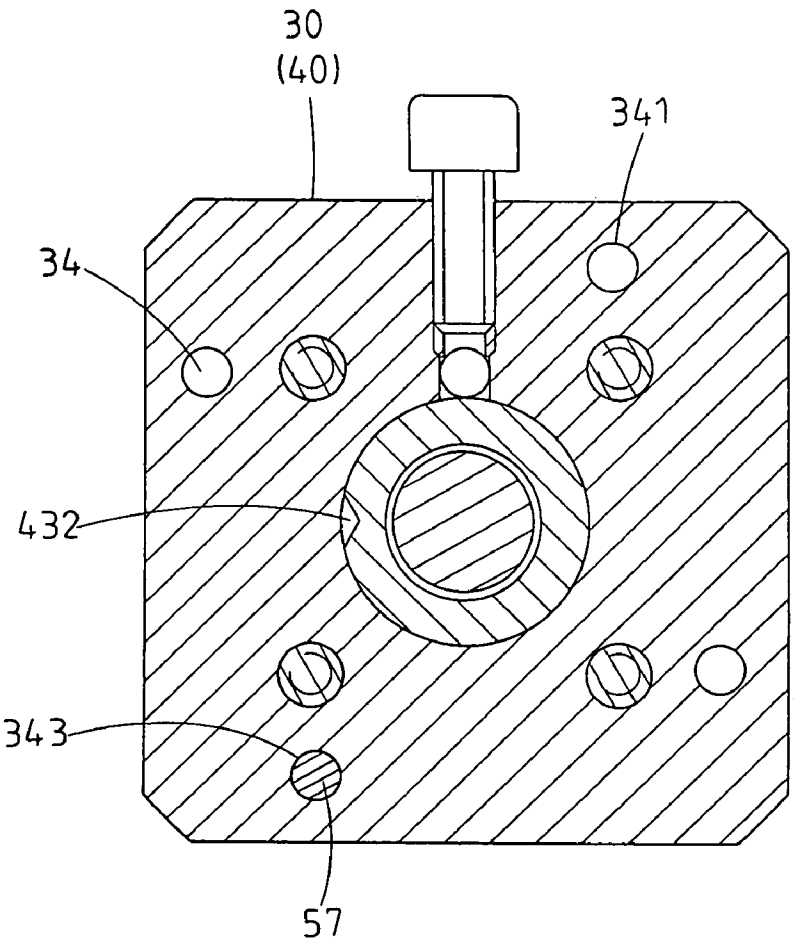
FIG. 12 is a view similar to FIG. 9, wherein the rotational seat is turned 90 degrees counterclockwise relative to the fixed seat.
Figure 11:
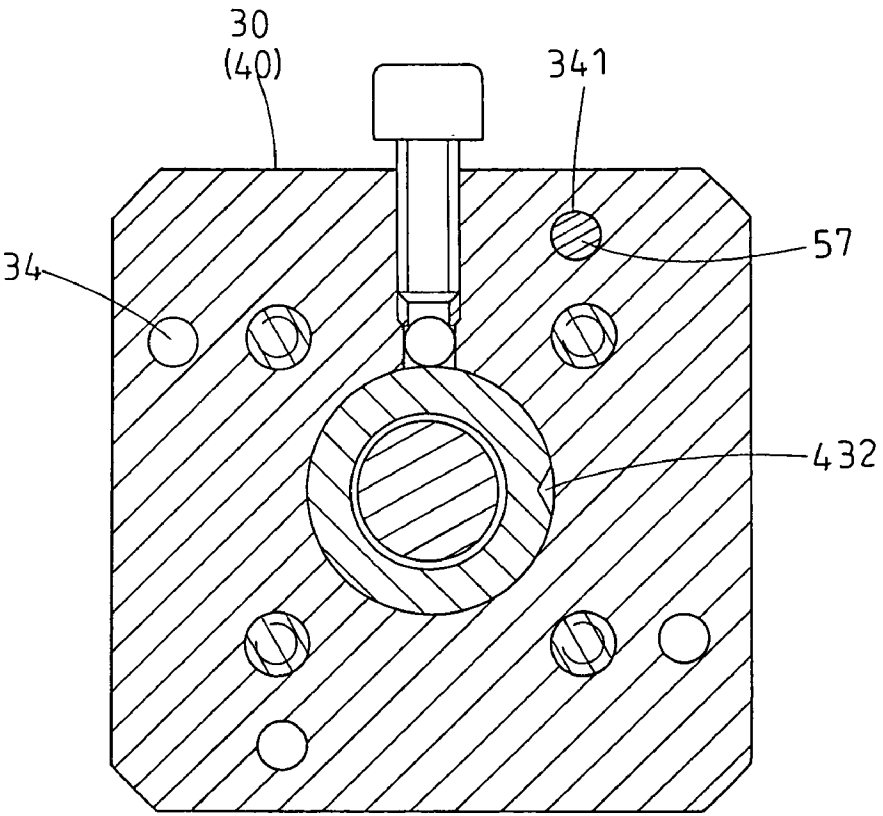
FIG. 11 is a view similar to FIG. 9, wherein the rotational seat is turned 90 degrees clockwise relative to the fixed seat.

In the preferred form shown in FIGS. 3 to 5, the front and rear beams 15 and 16 are formed by extrusion and include a hollow interior and a plurality of screw holes 18. The fixed seat 30 is fixed to an end face of the rear beam 16 by extending bolts 35 through screw holes 18 in the rear beam 16 and through-holes 31 in the fixed seat 30. The fixed seat 30 includes an axial hole 32 and a sleeve 33 extends from a face thereof in a longitudinal direction of the rotational shaft 20. In the preferred form, the fixed seat 30 further includes a plurality of positioning holes 34, 341, 342, and 343 and a radial screw hole 36 in communication with the axial hole 32. A ball 38 and a retaining member 37 are mounted in the radial screw hole 36, which will be described later. The rotational seat 40 is fixed to an end face of the front beam 15 by extending bolts 45 through through-holes 41 in the rotational seat 40 into screw holes 18 in the front beam 15, allowing joint movement of the rotational seat 40 and the front beam 15. The rotational seat 40 includes an axial hole 42 and a shaft sleeve 43 extending from a face thereof in the longitudinal direction of the rotational shaft 20. The shaft sleeve 43 extends through the axial hole 32 and the sleeve 33 of the fixed seat 30, and the rotational shaft 20 is rotatably extended through the shaft sleeve 43 of the rotational seat 40. A stop ring 46 is fixed to an end face of the shaft sleeve 43 by extending bolts 49 through holes 48 in the stop ring 46 and holes 431 in the end face of the shaft sleeve 43, with a peripheral edge of the stop ring 46 abutting against the end face of the sleeve 33 of the fixed seat 30, thereby preventing disengagement of the rotational seat 40 from the fixed seat 30 while allowing rotational movement of the rotational seat 40 relative to the fixed seat 30. With reference to FIG. 9, the shaft sleeve 43 of the rotational seat 40 further includes a conic recess 432 in an outer periphery thereof and a through-hole 44.

Figure 6:
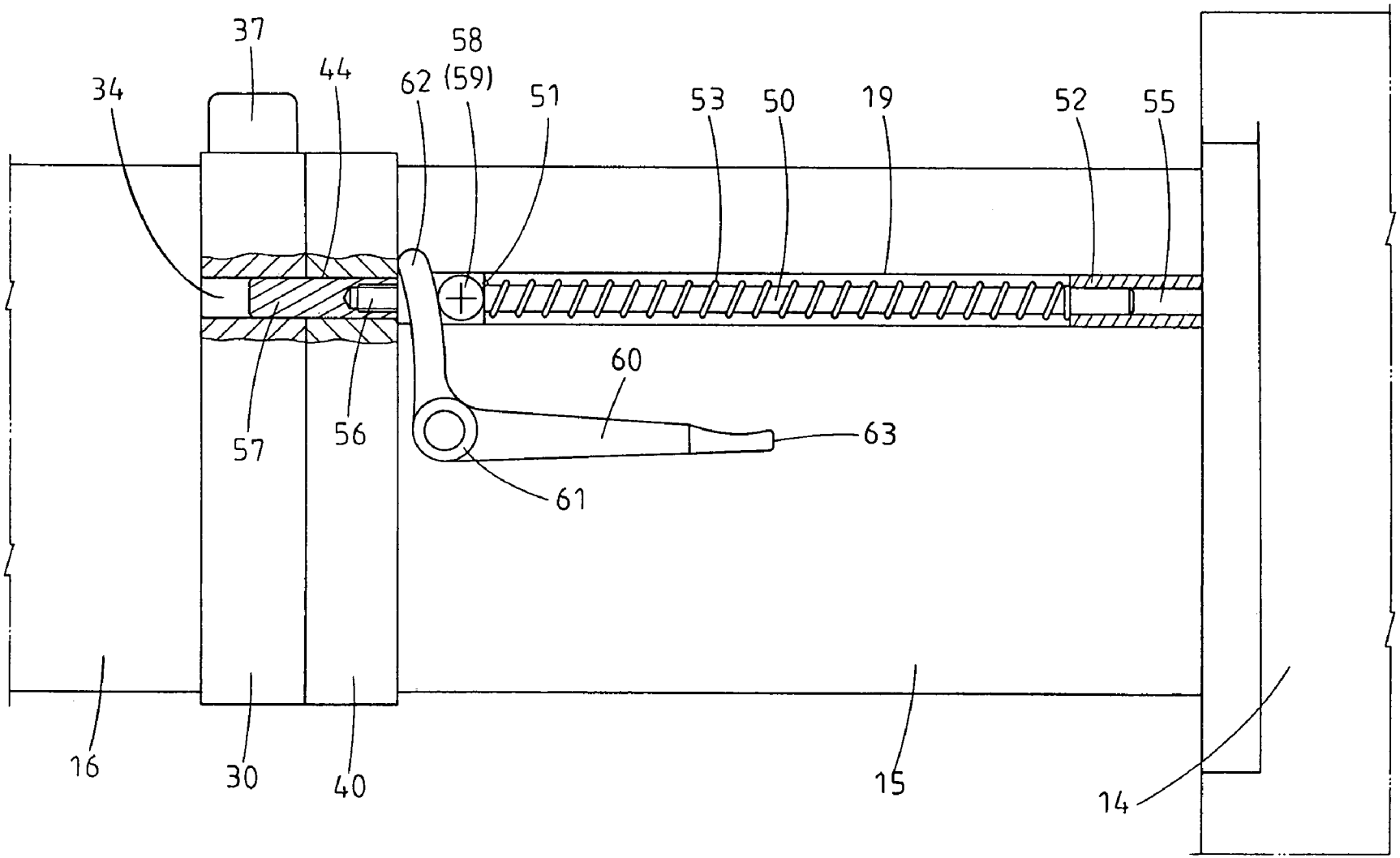
FIG. 6 is a side view, partly sectioned, of the portion of the beam shown in FIG. 3.
Figure 7:
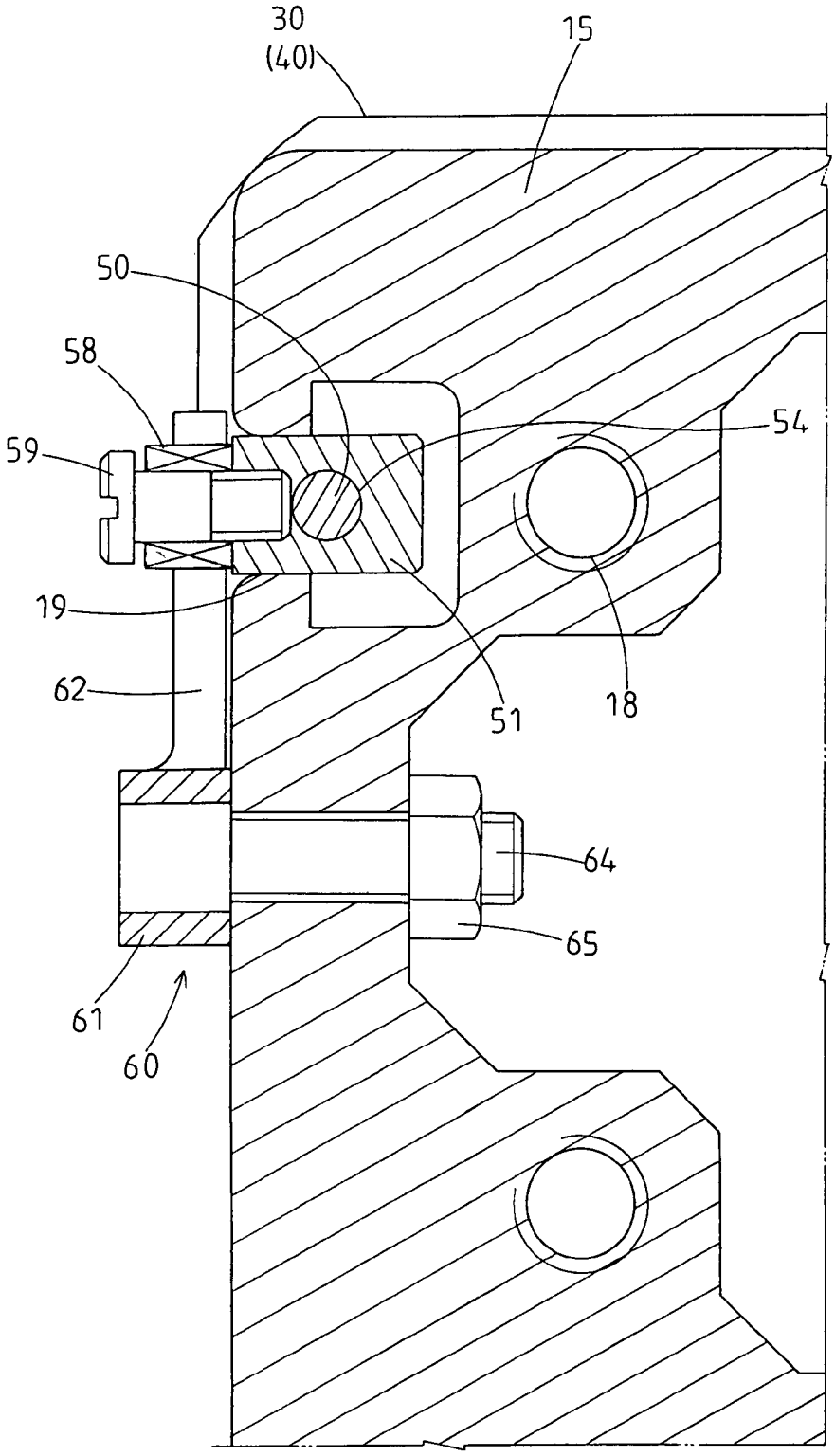
FIG. 7 is a sectional view illustrating detailed structure of the rocker arm and associated members of the adjustable positioning device.

In the preferred form shown in FIGS. 3, 6, and 7, the present invention further includes an auxiliary positioning device including a positioning rod 50 extending in a groove 19 in a lateral side of the front beam 15. An end of the positioning rod 50 is slideably received in a through-hole 54 in a guide seat 51, and the other end of the positioning rod 50 extends through a hole 55 of a fixed member 52 fixed in an end of the groove 19. A spring 53 is mounted around the positioning rod 50, with two ends of the spring 53 respectively abutting against the guide seat 51 and the fixed member 52. The end of the positioning rod 50 extends through the guide seat 51 includes a threaded section 56 for threading engagement with a screw hole (not labeled) in an end of a clutch pin 57 slideably received in the through-hole 44 of the rotational seat 40 and the positioning hole 34 of the fixed seat 30. A rocker arm 60 is provided to assist in operation of the positioning rod 50. In the preferred form shown in FIG. 7, the guide seat 51 includes a bearing 58 extending out of the groove 19 of the front beam 15, and a bolt 59 is extended through the bearing 58 and fixed to the guide seat 51. The rocker arm 60 includes a pivot pin 61 pivotally mounted to the front beam 15, a first arm 63 for manual operation, and a second arm 62 abutting against the bearing 58.

Figure 8:
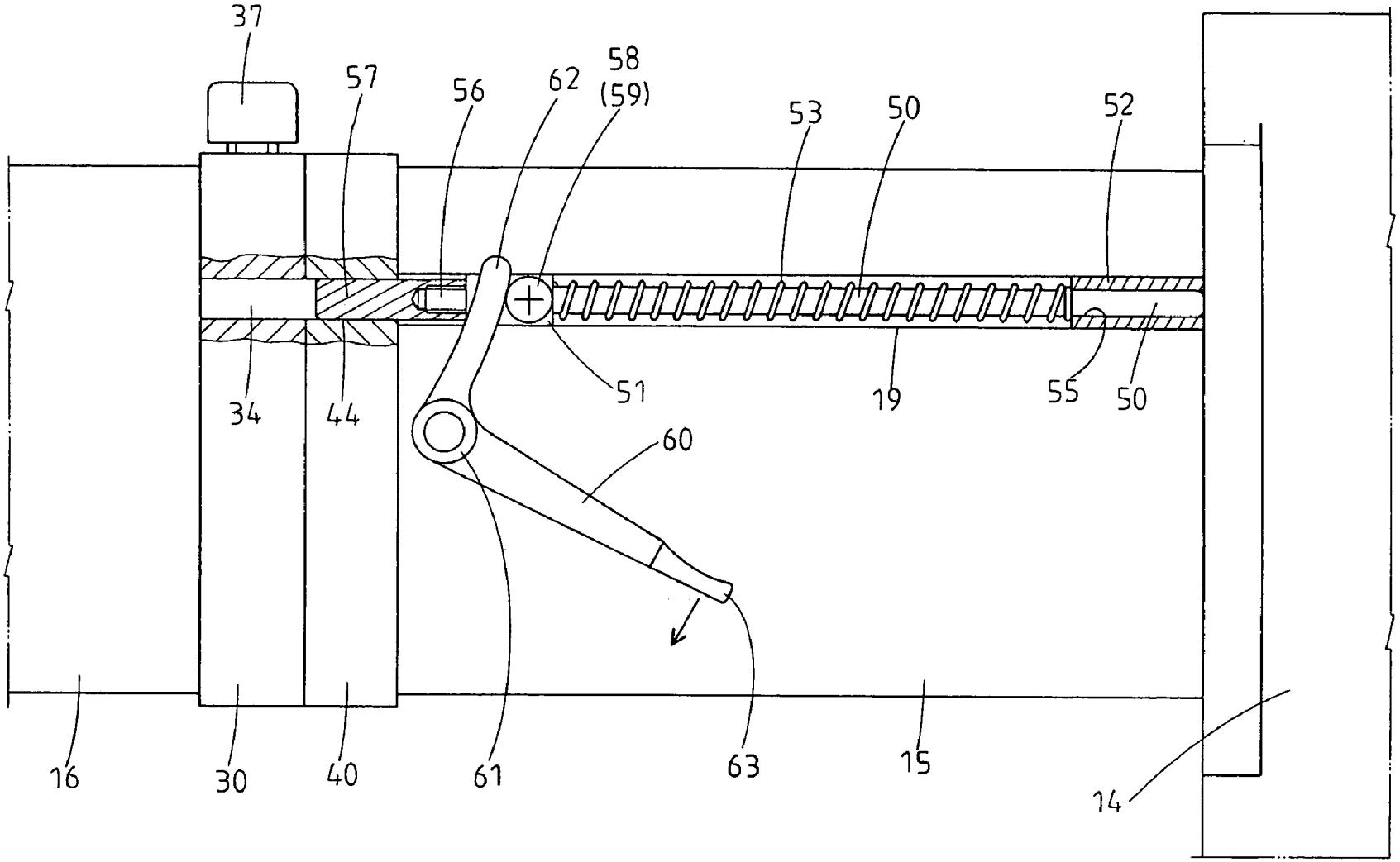
FIG. 8 is a view similar to FIG. 6, illustrating operation of a rocker arm.
Figure 10:
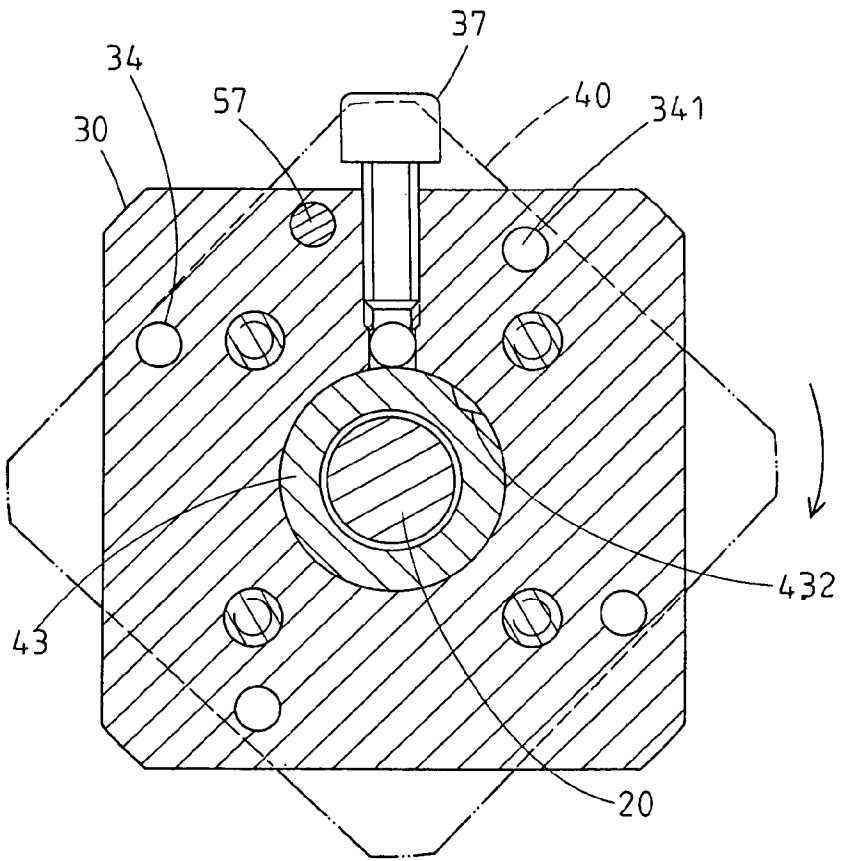
FIG. 10 is a view similar to FIG. 9, illustrating rotational movement of a rotational seat relative to a fixed seat of the adjustable positioning device.
Figure 13:
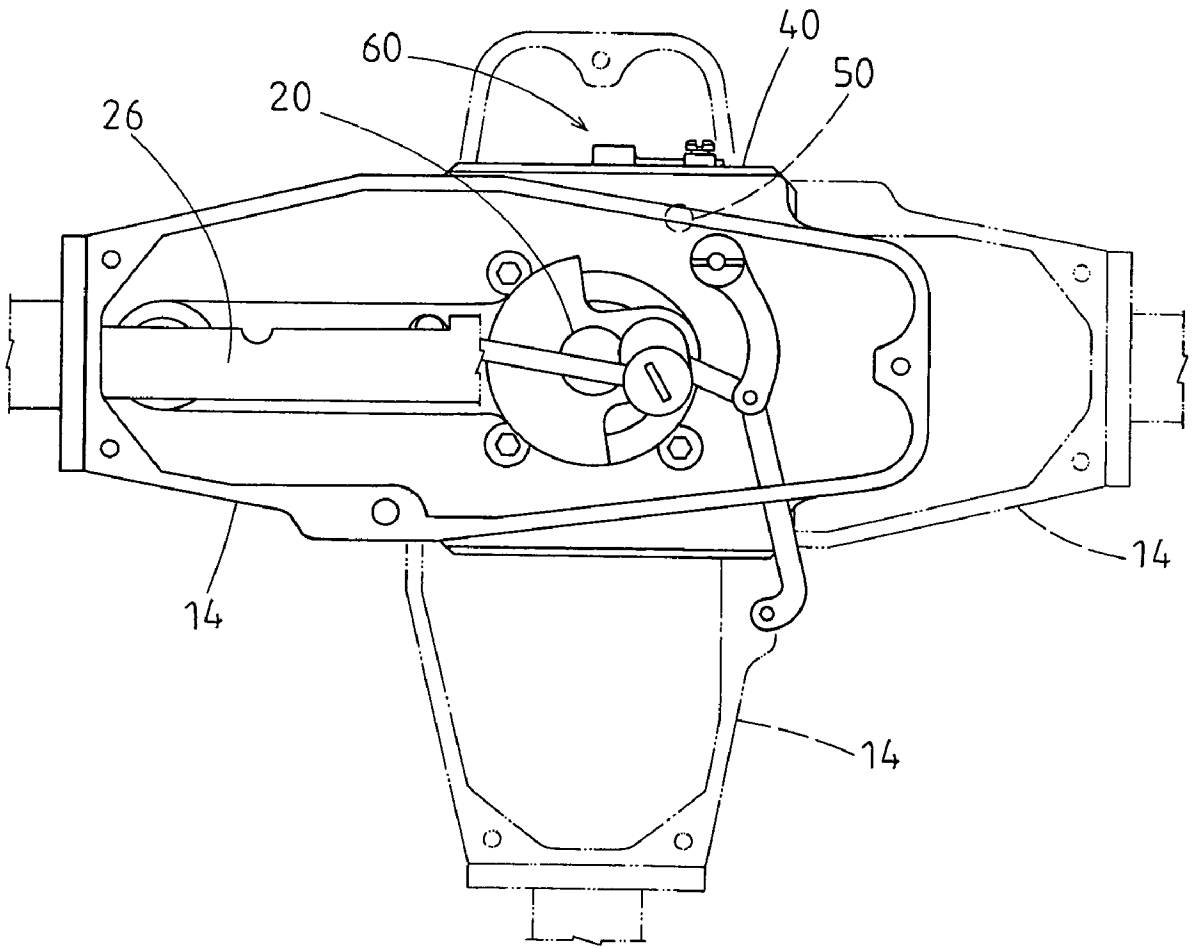
FIG. 13 is a view similar to FIG. 2, wherein the rotational seat is turned 90 degrees.

The retaining member 37 has a threaded portion threadedly engaged in the radial screw hole 36 of the fixed seat 30. For normal sewing operations, the retaining member 37 is turned to a tightening position in which the ball 38 is securely engaged in the conic recess 432 of the shaft sleeve 43 of the rotational seat 40, as illustrated in FIGS. 6 and 9. The head 14 is retained in an operative position, wherein a spacing exists between the head 14 and the needle seat 17 for sewing operation. When the retaining member 37 is turned loose, an operator can press the first arm 63 to pivot the rocker arm 60 about the pivot pin 61. Thus, the second arm 62 presses against and hence moves the bearing 58 laterally. The positioning rod 50 moves away from the rotational seat 40 until the clutch pin 57 is disengaged from the positioning hole 34 of the fixed seat 30. In this case, the head 14 and the rotational seat 40 can be turned relative to the fixed seat 30, as shown in FIGS. 8 and 10. For example, the head 14 and the rotational seat 40 can be turned 90 degrees clockwise to a position shown in FIG. 11 (see the solid line in FIG. 13) or 90 degrees counterclockwise to a position shown in FIG. 12 (see the dotted line in FIG. 13). In either case, the head 14 is moved to an inoperative position wherein the distance between the head 14 and the needle seat 17 is increased, allowing easy insertion and removal of thick materials before and after sewing operations. It is appreciated that the clutch pin 57 is urged to extend into another positioning hole 341, 342, or 343 under the action of the spring 53.

It is appreciated that the adjustable positioning device in accordance with the present invention can be operated without the auxiliary positioning device. Furthermore, the spring 53 provides an auxiliary positioning effect when the head 14 is moved to the inoperative position allowing easy insertion and removal of thick materials. Removal of rolled materials after sewing operation is also convenient.

Although specific embodiments have been illustrated and described, numerous modifications and variations are still possible without departing from the teachings of the invention. The scope of the invention is limited by the accompanying claims.

What is claimed is:

1. A sewing machine comprising:

a main frame including a needle seat, a beam, and a head supported by the beam, with the head and the needle seat having a spacing therebetween, with the head being rotatable relative to the beam, and with the head including means for sewing operation in association with the needle seat;

a fixed seat fixed to the beam, with the fixed seat including a first axial hole; and a rotational seat fixed to the head to turn therewith, with the rotational seat including a second axial hole aligned with the first axial hole of the fixed seat, with the rotational seat including a shaft sleeve rotatably extending through the first axial hole of the fixed seat, with the second axial hole and the shaft sleeve of the rotational seat being adapted to be extended through by a rotational shaft coupled to the head for the sewing operation, with the head and the rotational seat being movable relative to the fixed seat between an operative position allowing sewing operation and an inoperative position angularly spaced from the operative position, with the beam including a front beam and a rear beam, with the fixed seat and the rotational seat being mounted between the front and rear beams, with the fixed seat being fixed to the rear beam, with the rotational seat being mounted to an end of the front beam, and with the head being mounted to another end of the front beam.

2. The sewing machine as claimed in claim 1, with the fixed seat and the rotational seat being mounted between the beam and the head.

3. The sewing machine as claimed in claim 1, with the fixed seat further including a radial screw hole in communication with the first axial hole, with the rotational seat including a recess in an outer periphery thereof, further including a ball mounted in the radial screw hole of the fixed seat and releasably engageable with the recess of the rotational seat, further including a retaining member threadedly engaged with the radial screw hole and threadedly movable between a first position pressing the ball to be securely engaged with the recess of the rotational seat and a second position disengaged from the ball and allowing the ball to be disengaged from the recess of the rotational seat when the rotational seat is turned relative to the fixed seat.

4. A sewing machine comprising:

a main frame including a needle seat, a beam, and a head supported by the beam, with the head and the needle seat having a spacing therebetween, with the head being rotatable relative to the beam, and with the bead including means for sewing operation in association with the needle seat;

a fixed seat fixed to the beam, with the fixed seat including a first axial hole; and a rotational seat fixed to the head to turn therewith, with the rotational seat including a second axial hole aligned with the first axial hole of the fixed seat, with the rotational seat including a shaft sleeve rotatably extending through the first axial hole of the fixed seat, with the second axial hole and the shaft sleeve of the rotational seat being adapted to be extended through by a rotational shaft coupled to the head for the sewing operation, with the head and the rotational seat being movable relative to the fixed seat between an operative position allowing sewing operation and an inoperative position angularly spaced from the operative position, with the beam including a groove, with the rotational seat including a through-hole aligned with the groove, with the fixed seat including a first positioning hole aligned with the through-hole of the rotational seat, the sewing machine further including a positioning rod received in the groove, with a clutch pin attached to an end of the positioning rod and extending through the through-hole of the rotational seat into the first positional hole of the fixed seat, thereby maintaining the head in the operative position, with the positioning rod being movable to disengage the clutch pin from the first positioning hole of the fixed seat to allow rotational movement of the rotational seat relative to the fixed seat.

5. The sewing machine as claimed in claim 4, with the sewing machine further including a fixed member fixed in the groove and having a hole for slideable receipt of another end of the positioning rod, with the sewing machine further including a guide seat mounted in the groove and extended through by the positioning rod, with the sewing machine further including a spring mounted between the guide seat and the fixed member for biasing the clutch pin to engage with the first positioning hole of the fixed seat.

6. The sewing machine as claimed in claim 5, with the fixed seat further including a plurality of second positioning holes angularly spaced from the first positioning hole, with the clutch pin being selectively engaged with one of the second positioning holes when the head is in the inoperative position.

7. The sewing machine as claimed in claim 5, with the positioning rod including a bearing extending out of the groove, with a bolt extending through the bearing and fixed to the positioning rod, with the sewing machine further including a rocker arm, with the rocker arm including a pivot pin pivotally connected to the beam, a first arm for manual operation, and a second arm abutting against the bearing, with the first arm being pressable to move the clutch pin to disengage from the first positioning hole of the fixed seat.

8. The sewing machine as claimed in claim 6, with the positioning rod including a bearing extending out of the groove, with a bolt extending through the bearing and fixed to the positioning rod, with the sewing machine further including a rocker arm, with the rocker arm including a pivot pin pivotally connected to the beam, a first arm for manual operation, and a second arm abutting against the bearing, with the first arm being pressable to move the clutch pin to disengage from one of the first and second positioning holes of the fixed seat.

9. A sewing machine comprising:

a main frame including a needle seat, a beam, and a head supported by the beam, with the head and the needle seat having a spacing therebetween, with the head being rotatable relative to the beam, and with the head including means for sewing operation in association with the needle seat;

a fixed seat fixed to the beam, with the fixed seat including a first axial hole; and a rotational seat fixed to the head to turn therewith, with the rotational seat including a second axial hole aligned with the first axial hole of the fixed seat, with the rotational seat including a shaft sleeve rotatably extending through the first axial hole of the fixed seat, with the second axial hole and the shaft sleeve of the rotational seat being adapted to be extended through by a rotational shaft coupled to the head for the sewing operation, with the head and the rotational seat being movable relative to the fixed seat between an operative position allowing sewing operation and an inoperative position angularly spaced from the operative position, with the fixed seat further including a sleeve extending from a face thereof and extending in the longitudinal direction of the rotational shaft, with the shaft sleeve of the rotational seat extending through the sleeve of the fixed seat.

10. The sewing machine as claimed in claim 9, with the sewing machine further including a stop ring fixed to an end face of the shaft sleeve of the rotational seat and having a peripheral edge abutting against an end face of the sleeve of the fixed seat to prevent the rotational seat from disengaging from the fixed seat while allowing rotational movement of the rotational seat relative to the fixed seat.

* * * * *